US011328646B2

(12) United States Patent
Li et al.

(10) Patent No.: US 11,328,646 B2
(45) Date of Patent: May 10, 2022

(54) IMAGE PROCESSING APPARATUS AND OPERATION METHOD THEREOF THAT ADJUSTS IMAGE DATA ACCORDING TO PIXEL DEGRADATION

(71) Applicant: Novatek Microelectronics Corp., Hsinchu (TW)

(72) Inventors: Li Li, Shaanxi (CN); Qiqiang Han, Shaanxi (CN); JianHua Liang, ShaanXi Province (CN)

(73) Assignee: Novatek Microelectronics Corp., Hsinchu (TW)

( * ) Notice: Subject to any disclaimer, the term of this patent is extended or adjusted under 35 U.S.C. 154(b) by 207 days.

(21) Appl. No.: 16/727,922

(22) Filed: Dec. 27, 2019

(65) Prior Publication Data

US 2021/0150964 A1 May 20, 2021

(30) Foreign Application Priority Data

Nov. 20, 2019 (CN) ..... 201911142541.7

(51) Int. Cl.
*G09G 3/20* (2006.01)
*G09G 3/3258* (2016.01)

(52) U.S. Cl.
CPC ..... *G09G 3/2003* (2013.01); *G09G 3/3258* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 2005/0237345 | A1 | 10/2005 | Mizumaki et al. | |
| 2010/0277400 | A1* | 11/2010 | Jeong | G09G 3/3275 345/76 |
| 2016/0343301 | A1 | 11/2016 | Choi et al. | |
| 2016/0343349 | A1 | 11/2016 | Machida et al. | |
| 2017/0213493 | A1* | 7/2017 | Han | G09G 3/3208 |
| 2019/0080670 | A1 | 3/2019 | Jung et al. | |
| 2019/0156746 | A1 | 5/2019 | Kim et al. | |
| 2019/0259325 | A1* | 8/2019 | Chaji | G09G 3/2003 |

FOREIGN PATENT DOCUMENTS

| | | |
|---|---|---|
| CN | 101673519 | 3/2010 |
| CN | 104318893 | 1/2015 |
| CN | 106169283 | 11/2016 |
| CN | 107248392 | 10/2017 |
| EP | 1503360 | 2/2005 |
| KR | 20170079882 | 7/2017 |

OTHER PUBLICATIONS

"Office Action of China Counterpart Application", dated Sep. 27, 2021, p. 1-p. 8.

* cited by examiner

*Primary Examiner* — Kirk W Hermann
(74) *Attorney, Agent, or Firm* — JCIPRNET

(57) ABSTRACT

The image processing apparatus includes a sticking model circuit and a dynamic adjustment circuit. The sticking model circuit correspondingly provides degradation information according to pixel data of a current pixel. The dynamic adjustment circuit dynamically adjusts original image data of the current pixel according to the degradation information to generate output data. The dynamic adjustment circuit converts a first sub-pixel of the current pixel to at least one second sub-pixel of the current pixel when luminance is maintained. The dynamic adjustment circuit provides the output data to the sticking model circuit.

18 Claims, 6 Drawing Sheets

IMAGE PROCESSING APPARATUS AND OPERATION METHOD THEREOF THAT ADJUSTS IMAGE DATA ACCORDING TO PIXEL DEGRADATION

CROSS-REFERENCE TO RELATED APPLICATION

This application claims the priority benefit of Chinese application serial no. 201911142541.7, filed on Nov. 20, 2019. The entirety of the above-mentioned patent application is hereby incorporated by reference herein and made a part of this specification.

BACKGROUND

Technical Field

The disclosure relates to an electronic apparatus. More particularly, the disclosure relates to an image processing apparatus and an operation method thereof.

Description of Related Art

Some types of display panels are susceptible to image sticking. For instance, an organic light emitting diode (OLED) display panel may experience image sticking of a still object after the OLED display panel displays the still object over a period of time, and such phenomenon is the so-called burn-in phenomenon. The OLED display panel has an organic compound film. As a duration of the OLED display panel used is increased and heat is generated, an organic material of the OLED display panel is gradually degraded (aged). The phenomenon of image sticking of the OLED display panel actually refers to displaying of a same still image by some pixels in a certain fixed position on a screen for a long time, which causes the aging of the part of the organic compound film corresponding to these pixels to be faster than other parts of the organic compound film. These pixels, which degraded rapidly, leave image sticking on the screen. Generally, the burn-in phenomenon is irreversible.

The image sticking (burn-in) problem is a disadvantage of a white OLED. The compensation method and the avoidance method are the two methods adopted most of the time to solve this problem. In the compensation method, generally, a pixel circuit or a sensing circuit is additionally applied, and in this way, the circuit becomes complicated and expensive. Pixel shift, luminance reduction, and screen saver are included in the avoidance method. Pixel shift is only effective when being applied to boundaries. Luminance reduction may lead to luminance degradation. Screen saver is adapted for being applied to a long-term still image but has its own limitations when being applied in other applications.

It should be noted that the contents disclosed in the "Description of Related Art" section is used for enhancement of understanding of the disclosure. A part of the contents (or all of the contents) disclosed in the "Description of Related Art" section may not pertain to the conventional technology known to people having ordinary skill in the art. The information disclosed in the "Description of Related Art" section does not mean that the content is known to people having ordinary skill in the art before the filing of the disclosure.

SUMMARY

The disclosure provides an image processing apparatus and an operation method thereof through which image sticking may not occur easily.

An embodiment of the disclosure provides an image processing apparatus. The image processing apparatus includes a sticking model circuit and a dynamic adjustment circuit. The sticking model circuit is configured to correspondingly provide degradation information according to pixel data of a current pixel of a display panel. The current pixel includes a first sub-pixel and at least one second sub-pixel. The first sub-pixel and the at least one second sub-pixel have different colors. A dynamic adjustment circuit receives original image data of the current pixel and dynamically adjusts the original image data of the current pixel according to the degradation information to generate output data. The dynamic adjustment circuit includes a sub-pixel conversion circuit. The sub-pixel conversion circuit dynamically adjusts the original image data of the current pixel according to the degradation information and converts the first sub-pixel into the at least one second sub-pixel when luminance is maintained. The dynamic adjustment circuit provides the output data to the sticking model circuit, and the output data is configured to drive the display panel.

An embodiment of the disclosure provides an operation method of an image processing apparatus. The operation method includes the following steps. A sticking model circuit correspondingly provides degradation information according to pixel data of a current pixel of a display panel. The current pixel includes a first sub-pixel and at least one second sub-pixel. The first sub-pixel and the at least one second sub-pixel have different colors. A dynamic adjustment circuit receives original image data of the current pixel and dynamically adjusts the original image data of the current pixel according to the degradation information to generate output data. A sub-pixel conversion circuit of the dynamic adjustment circuit dynamically adjusts the original image data of the current pixel according to the degradation information and converts the first sub-pixel into the at least one second sub-pixel when luminance is maintained. The dynamic adjustment circuit provides the output data to the sticking model circuit, and the output data is configured to drive the display panel.

To sum up, in the embodiments of the disclosure, the image processing apparatus and the operation method thereof may correspondingly provide the degradation information according to the pixel data of the current pixel of the display panel. The dynamic adjustment circuit may dynamically adjust the original image data of the current pixel according to the degradation information and converts the first sub-pixel of the current pixel into the at least one second sub-pixel when luminance is maintained, so that image sticking may not easily occur in the current pixel.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
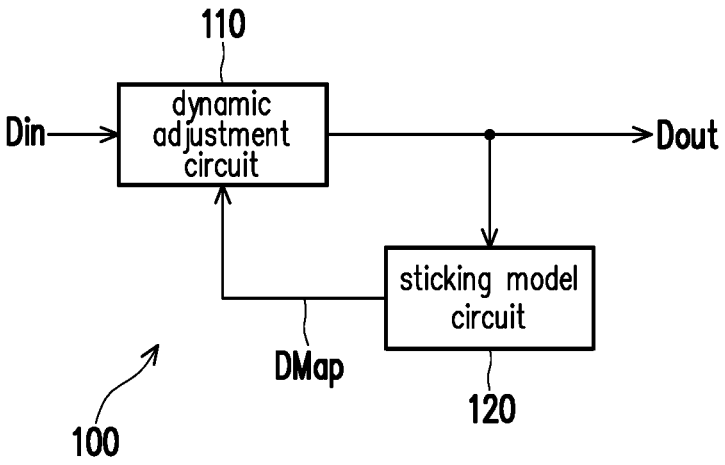
FIG. 1 is a schematic diagram of circuit blocks of an image processing apparatus according to an embodiment of the disclosure.

The term "coupled to (or connected to)" used in the entire specification (including claims) refers to any direct or indirect connecting means. For example, if the disclosure describes a first apparatus is coupled to (or connected to) a second apparatus, the description should be explained as the first apparatus that is connected directly to the second apparatus, or the first apparatus, through connecting other apparatus or using certain connecting means, is connected indirectly to the second apparatus. In addition, terms such as "first" and "second" in the entire specification (including claims) are used only to name the elements or to distinguish different embodiments or scopes and should not be construed as the upper limit or lower limit of the number of any element and should not be construed to limit the order of the elements. Moreover, elements/components/steps with the same reference numerals represent the same or similar parts in the figures and embodiments where appropriate. Descriptions of the elements/components/steps with the same reference numerals or terms in different embodiments may be references for one another.

Some types of display panels may have a phenomenon of image sticking. For instance, an organic light emitting diode (OLED) display panel may experience image sticking of a still image after the OLED display panel displays the still image over a period of time, and such image sticking phenomenon is a so-called burn-in (or referred to as burn-down) phenomenon. How to prevent the image sticking phenomenon from occurring is an important issue in the technical field of display apparatuses. In some embodiments, luminance of a sub-pixel (e.g., a white sub-pixel) susceptible to image sticking may be appropriately lowered, and in this way, a probability of occurrence of the image sticking phenomenon may be effectively lowered. When the luminance decreases, the pixel generates less heat, and that the probability of occurrence of the image sticking phenomenon may be lowered.

FIG. 1 is a schematic diagram of circuit blocks of an image processing apparatus 100 according to an embodiment of the disclosure. The image processing apparatus 100 of FIG. 1 includes a dynamic adjustment circuit 110 and a sticking model circuit 120. The dynamic adjustment circuit 110 is coupled to the sticking model circuit 120 to receive degradation information DMap.

Figure 2:
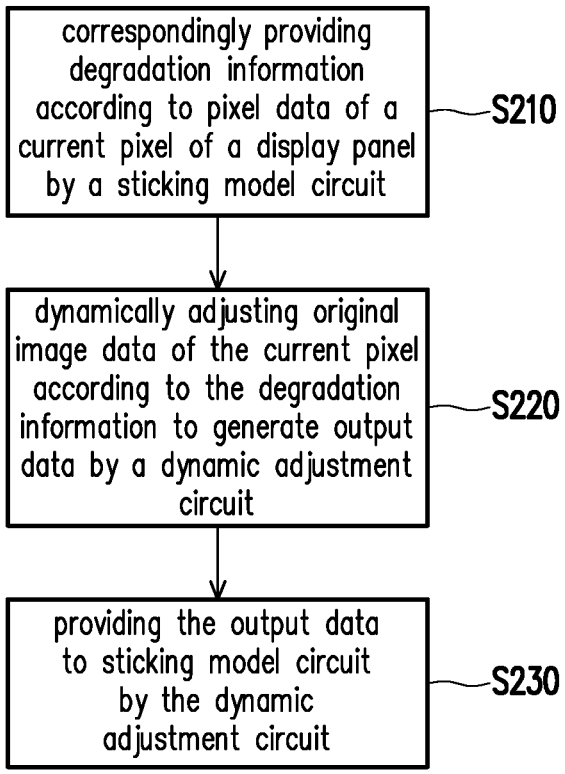
FIG. 2 is a schematic flow chart of an operation method of an image processing apparatus according to an embodiment of the disclosure.

FIG. 2 is a schematic flow chart of an operation method of an image processing apparatus according to an embodiment of the disclosure. With reference to FIG. 1 and FIG. 2, in step S210, the sticking model circuit 120 may correspondingly provide degradation information DMap to the dynamic adjustment circuit 110 according to pixel data of a current pixel of a display panel (not shown). Herein, the degradation information DMap (sticking model) may present a degradation degree of the current pixel. In other words, the degradation information DMap may indicate a possibility of image sticking (burn-in) that may occur in the current pixel. The sticking model circuit 120 receives new data (output data Dout) outputted by the dynamic adjustment circuit 110 and calculates the degradation information DMap of the current pixel according to the new data. Implementation of the sticking model circuit 120 is not limited by this embodiment. For instance, the sticking model circuit 120 may include a known sticking model circuit or other sticking model circuits that may generate the degradation information.

The dynamic adjustment circuit 110 may receive an original image data Din of the current pixel. In step S220, the dynamic adjustment circuit 110 may dynamically adjust the original image data Din of the current pixel according to the degradation information DMap to generate the output data Dout. The current pixel includes a first sub-pixel and at least one second sub-pixel. A color of the first sub-pixel is different from a color of each one of the at least one second sub-pixel. The dynamic adjustment circuit 110 includes a sub-pixel conversion circuit (not shown in FIG. 1, detailed description is provided in following paragraphs). The sub-pixel conversion circuit may dynamically adjust the original image data Din of the current pixel according to the degradation information DMap and converts the first sub-pixel into the at least one second sub-pixel when luminance is maintained. In step S230, the dynamic adjustment circuit 110 may provide the output data Dout the sticking model circuit 120, and the output data Dout is configured to drive the display panel (not shown).

For instance, the dynamic adjustment circuit 110 may receive original data of the first sub-pixel (e.g., a white sub-pixel) of the current pixel. The dynamic adjustment circuit 110 may dynamically adjust the original data of the first sub-pixel according to the degradation information DMap and obtains new data of the first sub-pixel. The new data of the first sub-pixel is configured to drive the first sub-pixel (e.g., the white sub-pixel circuit) of the current pixel of the display panel (not shown). The dynamic adjustment circuit 110 may receive original data of the at least one second sub-pixel (e.g., at least one of a red sub-pixel, a green sub-pixel, and a blue sub-pixel). The dynamic adjustment circuit 110 may dynamically adjust the original data of the at least one second sub-pixel according to the degradation information DMap and obtains new data. The new data of the at least one second sub-pixel is configured to drive the at least one second sub-pixel (e.g., at least one of the red sub-pixel, the green sub-pixel, and the blue sub-pixel) of the current pixel of the display panel (not shown). Therefore, when luminance is maintained, the dynamic adjustment circuit 110 may transfer luminance of the first sub-pixel to the at least one second sub-pixel.

For another instance, the dynamic adjustment circuit 110 may dynamically adjust a dynamic value according to the degradation information DMap. The dynamic adjustment circuit 110 may change the original data of the first sub-pixel (e.g., the white sub-pixel) according to this dynamic value and obtains first new data. The dynamic adjustment circuit 110 may further change the original data of the at least one second sub-pixel (e.g., at least one of the red sub-pixel, the green sub-pixel, and the blue sub-pixel) according to this dynamic value and obtains second new data, so as to compensate a luminance difference between the first new data and the original data. For instance, the dynamic adjustment circuit 110 may obtain the first new data by subtracting the dynamic value from original data of the white sub-pixel. In a process of displaying a still image by the display panel over a long period of time, luminance of the white sub-pixel susceptible to burn-in may be appropriately lowered. When the luminance decreases, the white sub-pixel generates less heat, and that a probability of occurrence of a burn-in phenomenon may be lowered. The dynamic adjustment circuit 110 may also obtain the second new data by adding this dynamic value to original data of the red sub-pixel, the green sub-pixel, and the blue sub-pixel, so as to compensate a luminance loss of the white sub-pixel. That is, even though the luminance of the white sub-pixel is lowered, the dynamic adjustment circuit 110 may increase luminance of the red sub-pixel, the green sub-pixel, and the blue sub-pixel. Therefore, luminance of the current pixel may be approximately maintained.

Figure 3:
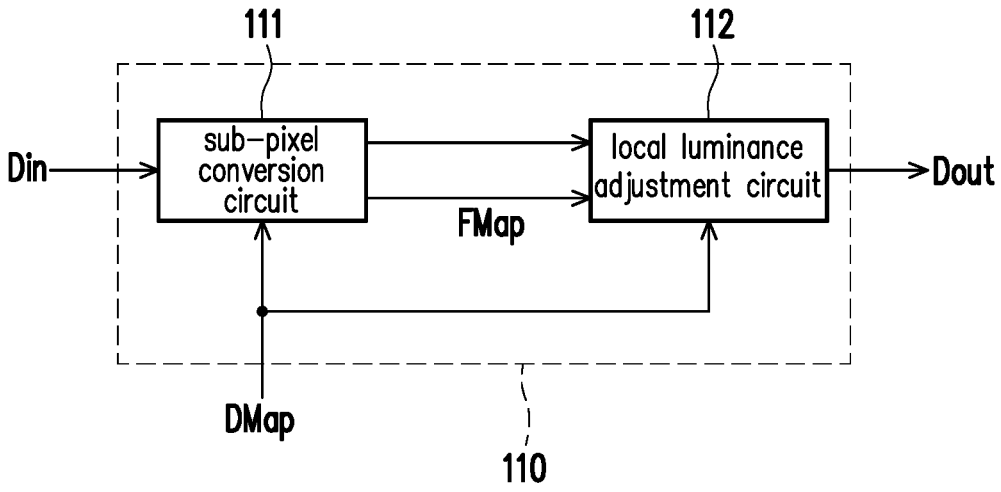
FIG. 3 is a schematic diagram of circuit blocks of a dynamic adjustment circuit of FIG. 1 according to an embodiment of the disclosure.

FIG. 3 is a schematic diagram of circuit blocks of the dynamic adjustment circuit 110 of FIG. 1 according to an embodiment of the disclosure. The dynamic adjustment circuit 110 shown in FIG. 3 includes a sub-pixel conversion circuit 111 and a local luminance adjustment circuit 112. The sub-pixel conversion circuit 111 receives the original image data Din of the current pixel. For instance, the sub-pixel conversion circuit 111 receives the original data of the white sub-pixel, the original data of the red sub-pixel, the original data of the green sub-pixel, and the original data of the blue sub-pixel.

According to design needs, in some embodiments, the degradation information DMap corresponding to the current pixel of the display panel (not shown) includes a sticking value of the first sub-pixel and a sticking value of the at least one second sub-pixel. The sub-pixel conversion circuit 111 of the dynamic adjustment circuit 110 may dynamically adjust the original image data of the current pixel according to the degradation information DMap, so as to balance the sticking value of the first sub-pixel and the sticking value of the at least one second sub-pixel. According to a difference between the sticking value of the first sub-pixel and the sticking value of the at least one second sub-pixel, the sub-pixel conversion circuit 111 of the dynamic adjustment circuit 110 may convert the first sub-pixel into the at least one second sub-pixel. When the difference between the first sticking value of the first sub-pixel and the sticking value of the at least one second sub-pixel increases, a conversion level of converting the first sub-pixel into the at least one second sub-pixel by the dynamic adjustment circuit 110 increases. When the difference between the first sticking value of the first sub-pixel and the sticking value of the at least one second sub-pixel decreases, the conversion level of converting the first sub-pixel into the at least one second sub-pixel by the dynamic adjustment circuit 110 decreases.

The sub-pixel conversion circuit 111 dynamically adjusts the dynamic value according to the degradation information DMap. The sub-pixel conversion circuit 111 changes the original data of the white sub-pixel according to the dynamic value and obtains first adjusted data of the white sub-pixel. The sub-pixel conversion circuit 111 changes the original data of the red sub-pixel, the green sub-pixel, and the blue sub-pixel according to the dynamic value and obtains adjusted data of the red sub-pixel, the green sub-pixel, and the blue sub-pixel, so as to compensate luminance loss of the first adjusted data. In addition, the sub-pixel conversion circuit 111 further generates conversion effectiveness information FMap according to the degradation information DMap and the original image data of the current pixel, so as to indicate an effective level of protection of image sticking.

The local luminance adjustment circuit 112 is coupled to the sub-pixel conversion circuit 111 to receive a conversion result (the adjusted data) and the conversion effectiveness information FMap. The local luminance adjustment circuit 112 may dynamically adjust a local adjustment gain value according to the degradation information DMap and the conversion effectiveness information FMap. The local luminance adjustment circuit 112 may change the conversion result (the adjusted data) of the sub-pixel conversion circuit 111 according to the local adjustment gain value and obtains the output data Dout.

Figure 4:
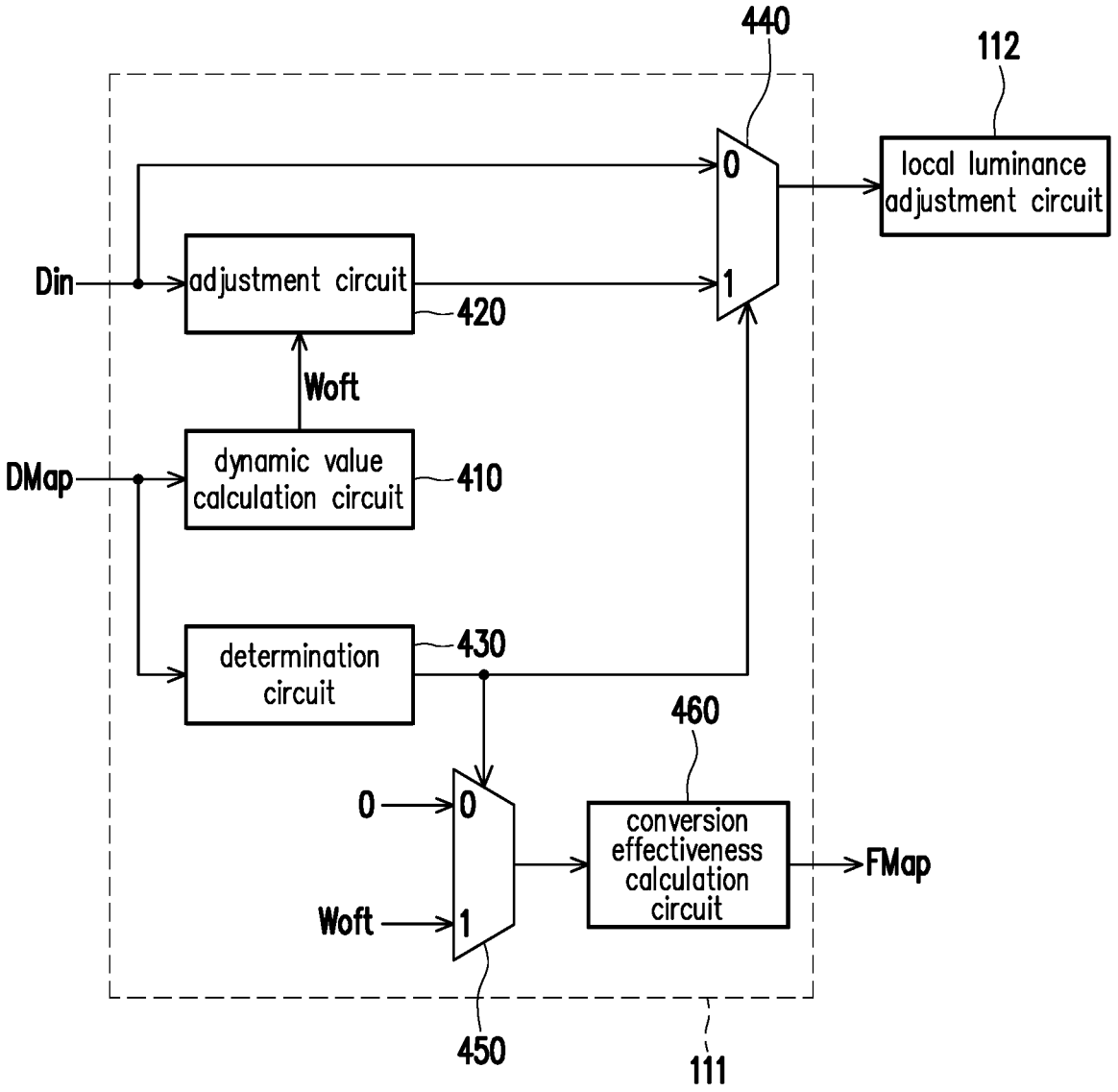
FIG. 4 is schematic diagram of circuit blocks of a sub-pixel conversion circuit of FIG. 3 according to an embodiment of the disclosure.

FIG. 4 is schematic diagram of circuit blocks of the sub-pixel conversion circuit 111 of FIG. 3 according to an embodiment of the disclosure. As shown in FIG. 4, the sub-pixel conversion circuit 111 includes a dynamic value calculation circuit 410, an adjustment circuit 420, a determination circuit 430, a multiplexer 440, a multiplexer 450, and a conversion effectiveness calculation circuit 460.

The dynamic value calculation circuit 410 is coupled to the sticking model circuit 120 to receive the degradation information DMap. The degradation information DMap includes a first sticking value DWMap of the white sub-pixel, a second sticking value DRMap of the red sub-pixel, a third sticking value DGMap of the green sub-pixel, and a fourth sticking value DBMap of the blue sub-pixel. The sticking values DRMap, DGMap, DBMap, and DWMap are outputted by the sticking model circuit 120 and represent sticking levels (represented by values ranging from 0 to 1) of a red channel, a green channel, a blue channel, and a white channel. When the sticking values decrease, the sticking levels lower. The dynamic value calculation circuit 410 calculates a dynamic value Woft by using the first sticking value DWMap, the second sticking value DRMap, the third sticking value DGMap, and the fourth sticking value DBMap.

For instance (but not limited thereto), the dynamic value calculation circuit 410 may solve Woft=min(DRMap, DGMap, DBMap)−DWMap to obtain the dynamic value Woft. Herein, min( ) represents a function of "calculating the minimum value". When a difference in sticking levels between the white sub-pixel and the RGB sub-pixels decreases, the dynamic value Woft (a conversion level from W to RGB) decreases. In contrast, when the difference in sticking levels between the white sub-pixel and the RGB sub-pixels increase, the dynamic value Woft increases. That is, the dynamic value calculation circuit 410 may balance the sticking value of the first sub-pixel and the sticking value of the at least one second sub-pixel according to the degradation information DMap.

The adjustment circuit 420 is coupled to the dynamic value calculation circuit 410 to receive the dynamic value Woft. The adjustment circuit 420 may receive the original image data Din of the current pixel. For instance, the adjustment circuit 420 receives the original data of the white sub-pixel, the original data of the red sub-pixel, the original data of the green sub-pixel, and the original data of the blue sub-pixel. The adjustment circuit 420 may obtain the adjusted data of the white sub-pixel, the red sub-pixel, the green sub-pixel, and the blue sub-pixel by subtracting the dynamic value Woft from the original data.

A first input end of the multiplexer 440 receives the original image data Din of the current pixel. A second input end of the multiplexer 440 is coupled to the adjustment circuit 420 to receive the conversion result (the adjusted data). An output end of the multiplexer 440 is coupled to the local luminance adjustment circuit 112.

The determination circuit 430 is coupled to the sticking model circuit 120 to receive the degradation information DMap. The determination circuit 430 controls routing of the multiplexer 440 and routing of the multiplexer 450 according to relationships among the first sticking value DWMap, the second sticking value DRMap, the third sticking value DGMap, and the fourth sticking value DBMap. For instance, (but not limited thereto), the determination circuit 430 may compare the DWMap with the min(DRMap, DGMap, DBMap), where min( ) represents the function of "calculating the minimum value". When the first sticking value DWMap of the white sub-pixel is less than the min(DRMap, DGMap, DBMap), the determination circuit 430 controls the multiplexer 440 to selectively output the adjusted data of the adjustment circuit 420, and the determination circuit 430 controls the multiplexer 450 to selectively output the dynamic value Woft. When the first sticking value DWMap of the white sub-pixel is greater than the min(DRMap, DGMap, DBMap), the determination circuit 430 controls the multiplexer 440 to selectively output the original image data Din of the current pixel, and the determination circuit 430 controls the multiplexer 450 to selectively output a fixed real number (e.g., "0" or other real numbers).

A first input end of the multiplexer 450 receives the real number (e.g., "0" or other real numbers). A second input end of the multiplexer 450 is coupled to the dynamic value calculation circuit 410 to receive the dynamic value Woft. An output end of the multiplexer 450 is coupled to an output end of the conversion effectiveness calculation circuit 460. When the multiplexer 450 outputs the dynamic value Woft to the conversion effectiveness calculation circuit 430, the conversion effectiveness calculation circuit 430 may calculate the conversion effectiveness information FMap according to the dynamic value Woft. For instance (but not limited thereto), the conversion effectiveness calculation circuit 430 may solve $FMap=\alpha_2\times(\alpha_1\times Woffset+(1-\alpha_1)\times(1\text{-}Wlumin))+(1-\alpha_2)\times(1-Woft)$ to obtain the conversion effectiveness information FMap. Herein, a real number $\alpha_1$ and a real number $\alpha_2$ mix coefficients (determined according to design needs), Woffset is an output of the multiplexer 450, and Wlumin is the original data of the white sub-pixel. A numerical range of the conversion effectiveness information FMAp is 0 to 1. When the conversion effectiveness information FMap is close to 0, it means that considerably insufficient protection is provided, so that further protection is performed in the local luminance adjustment circuit 112. When the conversion effectiveness information FMap is close to 1, it means that sufficient protection is provided, so that less protection is provided in the local luminance adjustment circuit 112.

Figure 5:
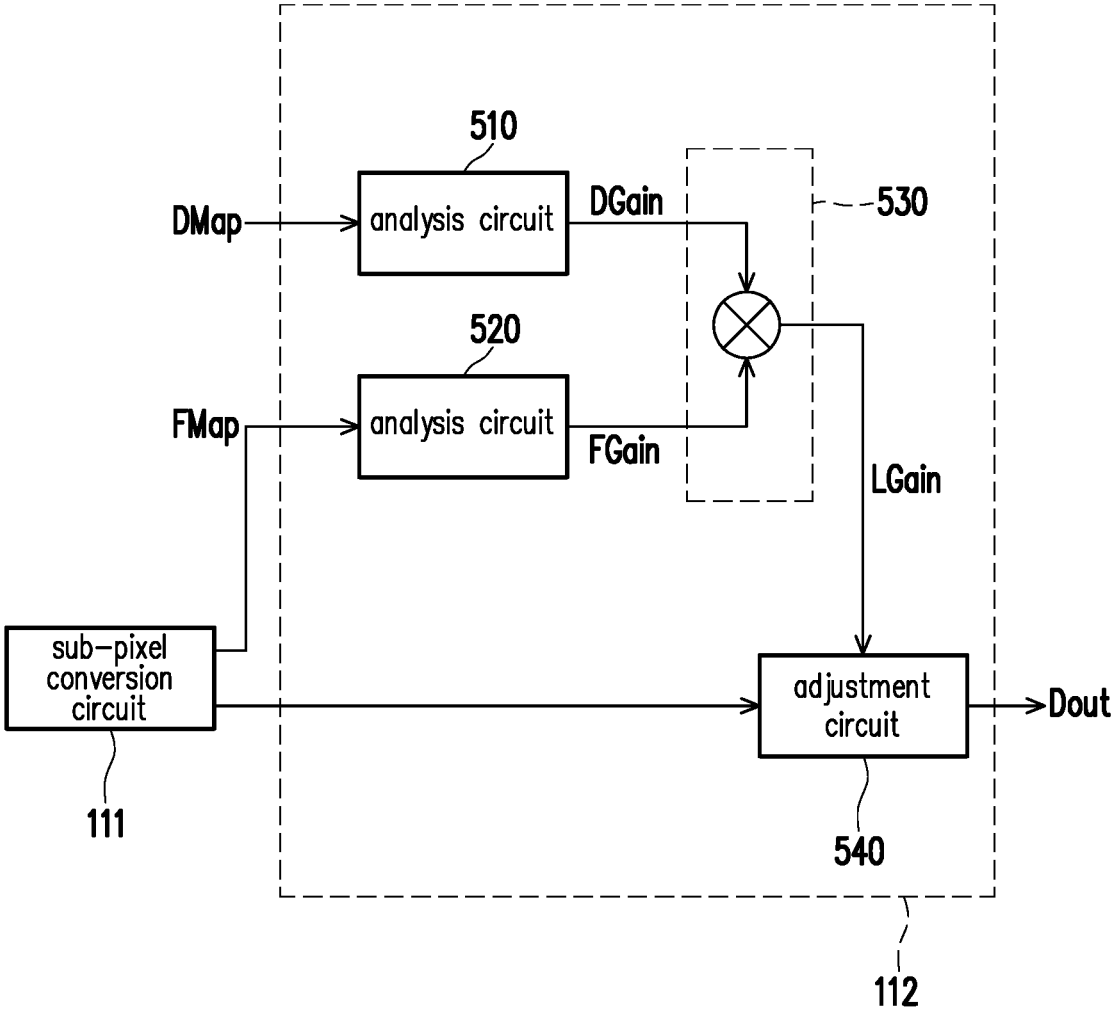
FIG. 5 is a schematic diagram of circuit blocks of a local luminance adjustment circuit of FIG. 3 according to an embodiment of the disclosure.

FIG. 5 is a schematic diagram of circuit blocks of the local luminance adjustment circuit 112 of FIG. 3 according to an embodiment of the disclosure. The local luminance adjustment circuit 112 adjusts global or local luminance through the degradation information DMap to decrease image sticking. First, the local luminance adjustment circuit 112 receives the degradation information DMap and performs local and global analyses. Next, the local luminance adjustment circuit 112 generates a gain value LGain according to local and global statistics. The local luminance adjustment circuit 112 may multiply image data by the calculated gain value LGain and may adjust luminance to decrease a stress applied on a pixel to prolong a lifespan of the pixel. In FIG. 5, the local luminance adjustment circuit 112 includes an analysis circuit 510, an analysis circuit 520, a mix circuit 530, and an adjustment circuit 540.

The analysis circuit 510 is coupled to the sticking model circuit 120 to receive the degradation information DMap. The analysis circuit 510 calculates a gain value DGain by using the degradation information DMap of the current pixel. For instance (but not limited thereto), the analysis circuit 510 may solve $DGain=\alpha*avg(DRMap, DGMap, DBMap, DWMap)+(1-\alpha)*min(DRMap, DGMap, DBMap, DWMap)$ to obtain the gain value DGain. Herein, the real number $\alpha$ is a mix coefficient (determined according to design needs), avg( ) represents a function of "calculating the average value", and min( ) represent a function of "calculating the minimum value". The degradation information DMap includes the first sticking value DWMap, the second sticking value DRMap, the third sticking value DGMap, and the fourth sticking value DBMap.

The analysis circuit 520 is coupled to the sub-pixel conversion circuit 111 to receive the conversion effectiveness information FMap. The analysis circuit 520 uses the conversion effectiveness information FMap of the current pixel to calculate a gain value FGain. For instance (but not limited thereto), a frame is divided into a plurality of non-overlapping blocks, and a block in which the current pixel is located is referred to as a current block. The analysis circuit 520 may calculate an average value of conversion effectiveness information FMap of all pixels in the current block (acting as an effectiveness average value FBlk). Next, the analysis circuit 520 may solve $FGain=FBlk*\beta$, where the real number $\beta$ is a coefficient (determined by design needs).

The mix circuit 530 is coupled to the analysis circuit 510 and the analysis circuit 520 to receive the gain values DGain and FGain. The mix circuit 530 mixes the gain value DGain and the gain value FGain to generate the local adjustment gain value LGain. In the embodiment shown by FIG. 5, the mix circuit 530 includes a multiplication circuit. A first input end of the multiplication circuit is coupled to the analysis circuit 510 to receive the gain value DGain. A second input end of the multiplication circuit is coupled to the analysis circuit 520 to receive the gain value FGain. An output end of the multiplication circuit is coupled to the adjustment circuit 540 to provide the local adjustment gain value LGain.

The adjustment circuit 540 is coupled to the mix circuit 530 to receive the local adjustment gain value LGain. The adjustment circuit 540 is coupled to the sub-pixel conversion circuit 111 to receive and adjust the conversion result (the adjusted data) of the sub-pixel conversion circuit 111. For instance (but not limited thereto), it is assumed that the conversion result outputted by the sub-pixel conversion circuit 111 includes adjusted data DW of the white sub-pixel, adjusted data DR of the red sub-pixel, adjusted data DG of the green sub-pixel, and adjusted data DB of the blue sub-pixel. The adjustment circuit 540 may solve DWout=DW*LGain to obtain output data DWout of the white sub-pixel. The adjustment circuit 540 may solve DRout=DR*LGain to obtain output data DRout of the red sub-pixel. The adjustment circuit 540 may solve DGout=DG*LGain to obtain output data DGout of the green sub-pixel. The adjustment circuit 540 may solve DBout=DB*LGain to obtain output data DBout of the blue sub-pixel. Output data Dout includes the output data DWout, DRout, DGout, and DBout.

Figure 6:
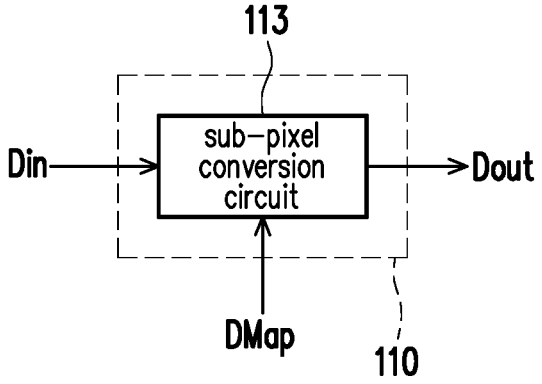
FIG. 6 is a schematic diagram of a circuit block of the dynamic adjustment circuit of FIG. 1 according to another embodiment of the disclosure.

FIG. 6 is a schematic diagram of a circuit block of the dynamic adjustment circuit 110 of FIG. 1 according to another embodiment of the disclosure. The dynamic adjustment circuit 110 shown in FIG. 6 includes a sub-pixel conversion circuit 113. The sub-pixel conversion circuit 113 receives the original image data Din of the current pixel. For instance, the sub-pixel conversion circuit 113 receives the original data of the white sub-pixel, the original data of the red sub-pixel, the original data of the green sub-pixel, and the original data of the blue sub-pixel. The sub-pixel conversion circuit 113 may dynamically adjust the dynamic value according to the degradation information DMap. The sub-pixel conversion circuit 113 may change the original data of the first sub-pixel (e.g., the white sub-pixel) according to this dynamic value and obtains the first new data. The sub-pixel conversion circuit 113 may change the original data of the red sub-pixel, the green sub-pixel, and the blue sub-pixel according to the dynamic value and obtains second new data, third new data, and fourth new data, so as to compensate luminance loss of the white sub-pixel. The output data Dout includes the first new data, the second new data, the third new data, and the fourth new data.

Figure 7:
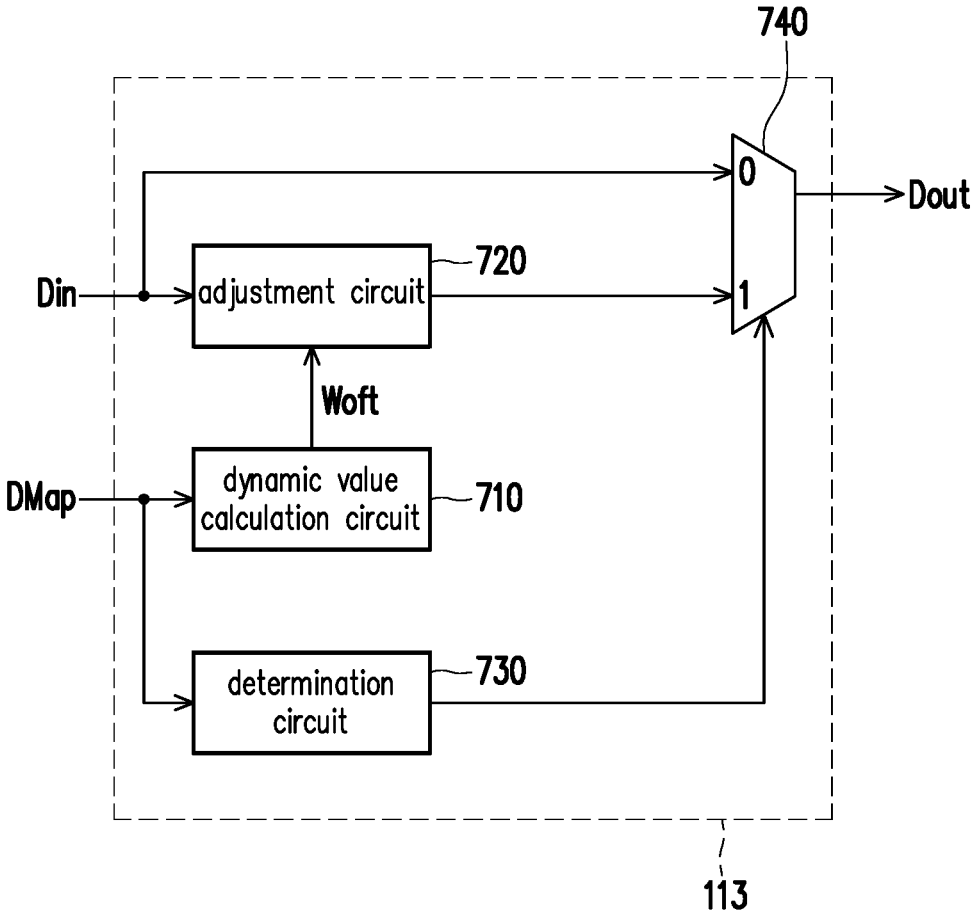
FIG. 7 is schematic diagram of circuit blocks of the sub-pixel conversion circuit of FIG. 6 according to an embodiment of the disclosure.

FIG. 7 is schematic diagram of circuit blocks of the sub-pixel conversion circuit 113 of FIG. 6 according to an embodiment of the disclosure. As shown in FIG. 7, the sub-pixel conversion circuit 113 includes a dynamic value calculation circuit 710, an adjustment circuit 720, a determination circuit 730, and a multiplexer 740. The dynamic value calculation circuit 710 is coupled to the sticking model circuit 120 to receive the degradation information DMap. The dynamic value calculation circuit 710 uses the degradation information DMap to calculate the dynamic value Woft. Related description of the dynamic value calculation circuit 710 shown in FIG. 7 may be deduced from that of the dynamic value calculation circuit 410 shown in FIG. 4 and thus is not provided herein.

The adjustment circuit 720 shown in FIG. 7 receives the original image data Din of the current pixel. For instance, the adjustment circuit 420 receives the original data of the white sub-pixel, the original data of the red sub-pixel, the original data of the green sub-pixel, and the original data of the blue sub-pixel. The adjustment circuit 720 is coupled to the dynamic value calculation circuit 710 to receive the dynamic value Woft. The adjustment circuit 720 may obtain the first new data by subtracting the dynamic value Woft from the original data of the white sub-pixel. The adjustment circuit 720 may obtain the second new data by adding the dynamic value Woft to the original data of the red sub-pixel. The adjustment circuit 720 may obtain the third new data by adding the dynamic value Woft to the original data of the green sub-pixel. The adjustment circuit 720 may obtain the fourth new data by adding the dynamic value Woft to the original data of the blue sub-pixel. Related description of the adjustment circuit 720 shown in FIG. 7 may be deduced from that of the adjustment circuit 420 shown in FIG. 4 and thus is not provided herein.

A first input end of the multiplexer 740 shown in FIG. 7 receives the original image data Din of the current pixel. For instance, the first input end of the multiplexer 740 receives the original data of the white sub-pixel, the original data of the red sub-pixel, the original data of the green sub-pixel, and the original data of the blue sub-pixel. A second input end of the multiplexer 740 is coupled to the adjustment circuit 720 to receive the adjusted data (i.e., the first new data, the second new data, the third new data, and the fourth new data). Related description of the multiplexer 740 shown in FIG. 7 may be deduced from that of the multiplexer 440 shown in FIG. 4 and thus is not provided herein. An output end of the multiplexer 740 shown in FIG. 7 is coupled to the sticking model circuit 120 to provide the output data Dout.

The determination circuit 730 is coupled to the sticking model circuit 120 to receive the degradation information DMap. The determination circuit 730 controls routing of the multiplexer 740 according to the relationships among the first sticking value DWMap, the second sticking value DRMap, the third sticking value DGMap, and the fourth sticking value DBMap. Related description of the determination circuit 730 shown in FIG. 7 may be deduced from that of the determination circuit 430 shown in FIG. 4 and thus is not provided herein.

Figure 8:
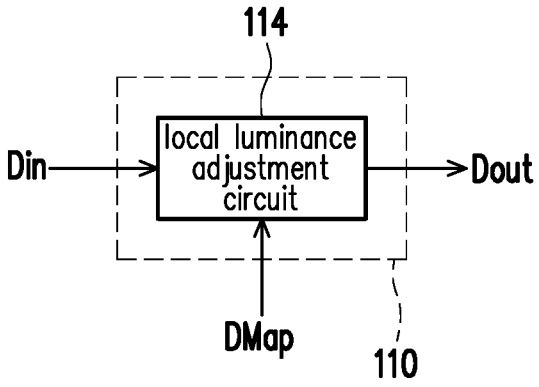
FIG. 8 is a schematic diagram of a circuit block of the dynamic adjustment circuit of FIG. 1 according to still another embodiment of the disclosure.

FIG. 8 is a schematic diagram of a circuit block of the dynamic adjustment circuit 110 of FIG. 1 according to still another embodiment of the disclosure. The dynamic adjustment circuit 110 shown in FIG. 8 includes a local luminance adjustment circuit 114. The local luminance adjustment circuit 114 receives the original image data Din of the current pixel. For instance, the local luminance adjustment circuit 114 receives the original data of the white sub-pixel, the original data of the red sub-pixel, the original data of the green sub-pixel, and the original data of the blue sub-pixel. The local luminance adjustment circuit 114 receives the original data of the first sub-pixel, the original data of the second sub-pixel, original data of a third sub-pixel, and original data of a fourth sub-pixel. The local luminance adjustment circuit 114 dynamically adjusts the local adjustment gain value according to the degradation information DMap. The local luminance adjustment circuit 114 changes the original data of the first sub-pixel, the second sub-pixel, the third sub-pixel, and the fourth sub-pixel, according to the local adjustment gain value and obtains the first new data of the first sub-pixel, the second new data of the second sub-pixel, the third new data of the third sub-pixel, and the fourth new data of the fourth sub-pixel. The output data Dout includes the first new data, the second new data, the third new data, and the fourth new data.

Figure 9:
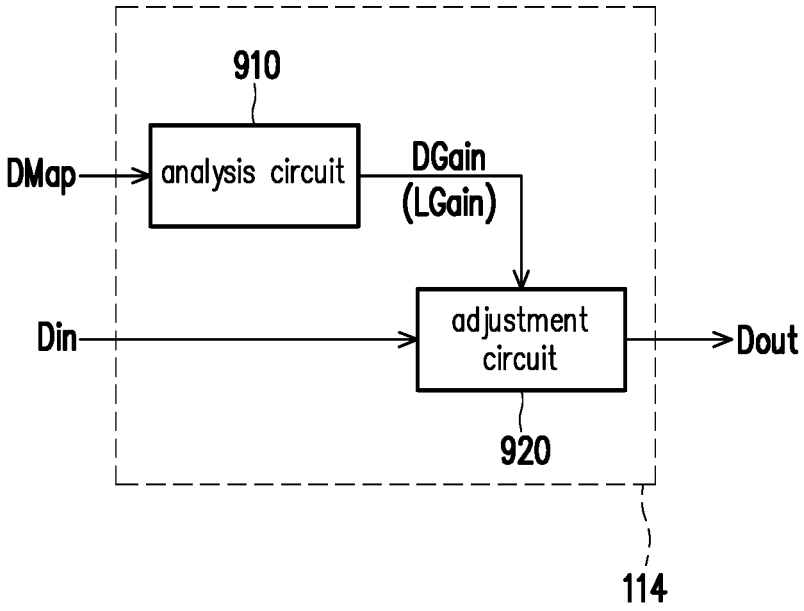
FIG. 9 is a schematic diagram of circuit blocks of the local luminance adjustment circuit of FIG. 8 according to an embodiment of the disclosure.

FIG. 9 is a schematic diagram of circuit blocks of the local luminance adjustment circuit 114 of FIG. 8 according to an embodiment of the disclosure. The local luminance adjustment circuit 114 shown in FIG. 9 includes an analysis circuit 910 and an adjustment circuit 920. The analysis circuit 910 is coupled to the sticking model circuit 120 to receive the degradation information DMap. The analysis circuit 920 calculates the gain value DGain (acting as the local adjustment gain value LGain) by using the degradation information DMap of the current pixel. Related description of the analysis circuit 910 shown in FIG. 9 may be deduced from that of the analysis circuit 510 shown in FIG. 5 and thus is not provided herein.

The adjustment circuit 920 is coupled to the analysis circuit 910 to receive the local adjustment gain value LGain. The adjustment circuit 920 receives the original image data Din of the current pixel. The adjustment circuit 920 changes the original image data Din according to the local adjustment gain value LGain and obtains the first new data of the first sub-pixel, the second new data of the second sub-pixel, the third new data of the third sub-pixel, and the fourth new data of the fourth sub-pixel. The output data Dout includes the first new data, the second new data, the third new data, and the fourth new data. Related description of the adjustment circuit 920 shown in FIG. 9 may be deduced from that of the adjustment circuit 540 shown in FIG. 5 and thus is not provided herein.

According to different design needs, the blocks of the dynamic adjustment circuit 110 and/or the sticking model circuit 120 may be implemented in a form of hardware, firmware, software (i.e., programs), or a combination of a plurality of the foregoing three.

In the form of hardware, the blocks of the dynamic adjustment circuit 110 and/or the sticking model circuit 120 may be implemented in the form of a logic circuit on an integrated circuit. Related functions of the dynamic adjustment circuit 110 and/or the sticking model circuit 120 may be implemented as hardware through using hardware description languages (e.g., Verilog HDL or VHDL) or other suitable programming languages. For instance, the related functions of the dynamic adjustment circuit 110 and/or the sticking model circuit 20 may be implemented as one or a plurality of controllers, micro controllers, microprocessors, application-specific integrated circuits (ASICs), digital signal processors (DSPs), field programmable gate arrays (FPGAs) and/or various logic blocks, modules, and circuits in other processing units.

In the form of software and/or firmware, the related functions of the dynamic adjustment circuit 110 and/or the sticking model circuit 120 may be implemented as programming codes. For instance, the dynamic adjustment circuit and/or the sticking model circuit 120 may be implemented by using a general programming language (e.g., C, C++, or an assembly language) or other suitable programming languages. The programming codes may be recorded/stored in a recording medium, and the recording medium includes, for example, a read only memory (ROM), a storage device, and/or a random access memory (RAM). A computer, a central processing unit (CPU), a controller, a microcontroller, or a microprocessor may read and execute the programming codes from the recording medium to accomplish the related functions. In terms of the recording medium, a "non-transitory computer readable medium" may be used. For instance, a tape, a disk, a card, semiconductor memory, a programmable logic circuit, etc. may be used. Further, the program may also be provided to the computer (or CPU) through any transmission medium (a communication network or a broadcast wave, etc.). The communication network includes, for example, Internet, wired communication, wireless communication, or other communication media.

In view of the foregoing, in the embodiments of the disclosure, the image processing apparatus 100 and the operation method thereof may correspondingly provide the degradation information DMap according to the pixel data of the current pixel of the display panel. The dynamic adjustment circuit 110 may dynamically adjust the original image data Din of the current pixel according to the degradation information DMap and converts the first sub-pixel of the current pixel into the at least one second sub-pixel when luminance is maintained, so that image sticking may not easily occur in the current pixel.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An image processing apparatus, wherein the image processing apparatus comprises one or a plurality of microprocessors and a plurality of circuits, and being configured as:

a sticking model circuit configured to correspondingly provide degradation information according to pixel data of a current pixel of a display panel, wherein the current pixel comprises a first sub-pixel and at least one second sub-pixel, and the first sub-pixel and the at least one second sub-pixel have different colors; and a dynamic adjustment circuit, receiving original image data of the current pixel and dynamically adjusting the original image data of the current pixel according to the degradation information to generate output data, wherein the dynamic adjustment circuit comprises a sub-pixel conversion circuit, and the sub-pixel conversion circuit dynamically adjusts the original image data of the current pixel according to the degradation information and converts the first sub-pixel into the at least one second sub-pixel when luminance is maintained, wherein the dynamic adjustment circuit provides the output data to the sticking model circuit, and the output data is configured to drive the display panel.

2. The image processing apparatus as claimed in claim 1, wherein the dynamic adjustment circuit receives first original data of the first sub-pixel of the current pixel, the dynamic adjustment circuit dynamically adjusts the first original data of the first sub-pixel according to the degradation information and obtains first new data of the first sub-pixel, and the first new data is configured to drive the first sub-pixel of the current pixel of the display panel, and the dynamic adjustment circuit receives at least one second original data of the at least one second sub-pixel, the dynamic adjustment circuit dynamically adjusts the at least one second original data of the at least one second sub-pixel according to the degradation information and obtains at least one second new data, and the at least one second new data is configured to drive the at least one second sub-pixel of the current pixel of the display panel.

3. The image processing apparatus as claimed in claim 1, wherein the degradation information corresponding to the current pixel of the display panel comprises a first sticking value of the first sub-pixel and at least one second sticking value of the at least one second sub-pixel.

4. The image processing apparatus as claimed in claim 3, wherein the sub-pixel conversion circuit of the dynamic adjustment circuit dynamically adjusts the original image data of the current pixel according to the degradation information, so as to balance the first sticking value of the first sub-pixel and the at least one second sticking value of the at least one second sub-pixel.

5. The image processing apparatus as claimed in claim 3, wherein the sub-pixel conversion circuit of the dynamic adjustment circuit converts the first sub-pixel into the at least one second sub-pixel according to a difference between the first sticking value of the first sub-pixel and the at least one second sticking value of the at least one second sub-pixel.

6. The image processing apparatus as claimed in claim 5, wherein a conversion level of converting the first sub-pixel into the at least one second sub-pixel by the dynamic adjustment circuit increases when the difference between the first sticking value and the at least one second sticking value of the at least one second sub-pixel increases, and the conversion level of converting the first sub-pixel into the at least one second sub-pixel by the dynamic adjustment circuit decreases when the difference between the first sticking value and the at least one second sticking value of the at least one second sub-pixel decreases.

7. The image processing apparatus as claimed in claim 1, wherein the first sub-pixel is a white sub-pixel, and the at least one second sub-pixel comprises at least one of a red sub-pixel, a green sub-pixel, and a blue sub-pixel.

8. The image processing apparatus as claimed in claim 1, wherein the sub-pixel conversion circuit of the dynamic adjustment circuit generates conversion effectiveness information according to the degradation information and the original image data of the current pixel, so as to indicate an effective level of protection of image sticking, and the dynamic adjustment circuit further comprises:

a local luminance adjustment circuit configured to dynamically adjust a local adjustment gain value according to the degradation information and the conversion effectiveness information, and the local luminance adjustment circuit changes a conversion result of the sub-pixel conversion circuit according to the local adjustment gain value.

9. The image processing apparatus as claimed in claim 8, wherein the local luminance adjustment circuit comprises:

a first analysis circuit, coupled to the sticking model circuit to receive the degradation information, wherein the first analysis circuit calculates a first gain value by using the degradation information of the current pixel;

a second analysis circuit, coupled to the sub-pixel conversion circuit to receive the conversion effectiveness information, wherein the second analysis circuit calculates a second gain value by using the conversion effectiveness information of the current pixel;

a mix circuit, coupled to the first analysis circuit to receive the first gain value and coupled to the second analysis circuit to receive the second gain value, wherein the mix circuit mixes the first gain value and the second gain value to generate the local adjustment gain value; and an adjustment circuit, coupled to the mix circuit to receive the local adjustment gain value and coupled to the sub-pixel conversion circuit to receive and adjust the conversion result of the sub-pixel conversion circuit.

10. An operation method of an image processing apparatus, wherein the image processing apparatus comprises one or a plurality of microprocessors and a plurality of circuits, and being configured to perform the operation method, wherein the operation method comprises:

correspondingly providing degradation information according to pixel data of a current pixel of a display panel by a sticking model circuit, wherein the current pixel comprises a first sub-pixel and at least one second sub-pixel, and the first sub-pixel and the at least one second sub-pixel have different colors;

receiving original image data of the current pixel and dynamically adjusting the original image data of the current pixel according to the degradation information to generate output data by a dynamic adjustment circuit;

dynamically adjusting the original image data of the current pixel according to the degradation information and converting the first sub-pixel into the at least one second sub-pixel when luminance is maintained by a sub-pixel conversion circuit of the dynamic adjustment circuit; and providing the output data to the sticking model circuit by the dynamic adjustment circuit, wherein the output data is configured to drive the display panel.

11. The operation method as claimed in claim 10, wherein the operation method further comprises:

dynamically adjusting first original data of the first sub-pixel of the current pixel according to the degradation information and obtaining first new data of the first sub-pixel by the dynamic adjustment circuit, wherein the first new data is configured to drive the first sub-pixel of the current pixel of the display panel, and dynamically adjusting at least one second original data of the at least one second sub-pixel according to the degradation information and obtaining at least one second new data by the dynamic adjustment circuit, wherein the at least one second new data is configured to drive the at least one second sub-pixel of the current pixel of the display panel.

12. The operation method as claimed in claim 10, wherein the degradation information corresponding to the current pixel of the display panel comprises a first sticking value of the first sub-pixel and at least one second sticking value of the at least one second sub-pixel.

13. The operation method as claimed in claim 12, wherein the operation method further comprises:

dynamically adjusting the original image data of the current pixel according to the degradation information by the sub-pixel conversion circuit of the dynamic adjustment circuit, so as to balance the first sticking value of the first sub-pixel and the at least one second sticking value of the at least one second sub-pixel.

14. The operation method as claimed in claim 12, wherein the operation method further comprises:

converting the first sub-pixel into the at least one second sub-pixel by the sub-pixel conversion circuit of the dynamic adjustment circuit according to a difference between the first sticking value of the first sub-pixel and the at least one second sticking value of the at least one second sub-pixel.

15. The operation method as claimed in claim 14, wherein a conversion level of converting the first sub-pixel into the at least one second sub-pixel by the dynamic adjustment circuit increases when the difference between the first sticking value and the at least one second sticking value of the at least one second sub-pixel increases, and the conversion level of converting the first sub-pixel into the at least one second sub-pixel by the dynamic adjustment circuit decreases when the difference between the first sticking value and the at least one second sticking value of the at least one second sub-pixel decreases.

16. The operation method as claimed in claim 10, wherein the first sub-pixel is a white sub-pixel, and the at least one second sub-pixel comprises at least one of a red sub-pixel, a green sub-pixel, and a blue sub-pixel.

17. The operation method as claimed in claim 10, wherein the operation method further comprises:

generating conversion effectiveness information according to the degradation information and the original image data of the current pixel by the sub-pixel conversion circuit of the dynamic adjustment circuit, so as to indicate an effective level of protection of image sticking;

dynamically adjusting a local adjustment gain value according to the degradation information and the conversion effectiveness information by a local luminance adjustment circuit of the dynamic adjustment circuit; and changing a conversion result of the sub-pixel conversion circuit according to the local adjustment gain value by the local luminance adjustment circuit.

18. The operation method as claimed in claim 17, wherein the operation method further comprises:

receiving the degradation information by a first analysis circuit;

calculating a first gain value by using the degradation information of the current pixel by the first analysis circuit;

receiving the conversion effectiveness information by a second analysis circuit;

calculating a second gain value by using the conversion effectiveness information of the current pixel by the second analysis circuit;

receiving the first gain value and the second gain value by a mix circuit;

wherein the mix circuit mixes the first gain value and the second gain value to generate the local adjustment gain value; and receiving the local adjustment gain value by the adjustment circuit; and receiving and adjusting the conversion result of the sub-pixel conversion circuit by the adjustment circuit.

* * * * *